US010239180B2

(12) United States Patent
Mukaiyama

(10) Patent No.: US 10,239,180 B2
(45) Date of Patent: Mar. 26, 2019

(54) OPTICAL ELEMENT PROCESSING TOOL AND OPTICAL ELEMENT MANUFACTURING METHOD

(71) Applicant: OLYMPUS CORPORATION, Hachioji-shi, Tokyo (JP)

(72) Inventor: Shuji Mukaiyama, Nagano (JP)

(73) Assignee: OLYMPUS CORPORATION, Tokyo (JP)

( * ) Notice: Subject to any disclaimer, the term of this patent is extended or adjusted under 35 U.S.C. 154(b) by 0 days.

(21) Appl. No.: 15/622,044

(22) Filed: Jun. 13, 2017

(65) Prior Publication Data

US 2017/0274491 A1 Sep. 28, 2017

Related U.S. Application Data

(63) Continuation of application No. PCT/JP2015/075047, filed on Sep. 3, 2015.

(30) Foreign Application Priority Data

Dec. 17, 2014 (JP) ..... 2014-255416

(51) Int. Cl.
*B24B 13/01* (2006.01)
*B24D 7/18* (2006.01)
*B24B 13/02* (2006.01)

(52) U.S. Cl.
CPC ..... *B24B 13/01* (2013.01); *B24B 13/02* (2013.01); *B24D 7/18* (2013.01)

(58) Field of Classification Search
CPC ..... B24B 13/02; B24B 13/012; B24B 7/241; B24D 7/18
See application file for complete search history.

(56) References Cited

U.S. PATENT DOCUMENTS 2,747,340 A * 5/1956 Angenieux ..... B24B 13/023 451/277
3,816,997 A * 6/1974 Rupp ..... B24B 13/02 451/277

(Continued)

FOREIGN PATENT DOCUMENTS

JP 55179754 U 12/1980
JP 2000084820 A 3/2000

(Continued)

OTHER PUBLICATIONS

Japanese Office Action dated May 8, 2018 (and English language translation thereof) issued in counterpart Japanese Application No. 2014-255416.

(Continued)

*Primary Examiner* — Timothy V Eley
(74) *Attorney, Agent, or Firm* — Holtz, Holtz & Volek PC

(57) ABSTRACT

An optical element processing tool for grinding or polishing an optical element includes: a base plate including a fixing region having a predetermined curvature; and a plurality of grindstones each formed in a columnar body having a same initial height, one end surface of the columnar body having an initial shape molded into a first spherical shape conforming to a processing target spherical shape of the optical element, and the other end surface of the columnar body being fixed to the fixing region of the base plate. A grindstone deviant from a condition among the plurality of grindstones, which is the grindstone not meeting a condition determined by a processing tool diameter of the processing tool, includes an outer end portion cut out at least in parallel to a center axis of the base plate so as to meet the condition.

6 Claims, 9 Drawing Sheets

(56) References Cited

U.S. PATENT DOCUMENTS

| | | | | |
|---|---|---|---|---|
| 3,827,192 | A * | 8/1974 | Ferrand | B24B 13/02 451/277 |
| 5,593,340 | A * | 1/1997 | Nelson | B24B 13/01 451/42 |
| 6,933,018 | B2 * | 8/2005 | Masuko | B24B 13/01 427/282 |
| 7,278,908 | B2 * | 10/2007 | Urban | B24B 13/012 451/259 |
| 8,246,424 | B2 * | 8/2012 | Philipps | B24B 13/02 156/256 |

FOREIGN PATENT DOCUMENTS

| | | | |
|---|---|---|---|
| JP | 2004034221 | A | 2/2004 |
| JP | 2014172106 | A | 9/2014 |

OTHER PUBLICATIONS

International Search Report (ISR) and Written Opinion dated Nov. 10, 2015 issued in International Application No. PCT/JP2015/075047.

* cited by examiner

OPTICAL ELEMENT PROCESSING TOOL AND OPTICAL ELEMENT MANUFACTURING METHOD

CROSS-REFERENCE TO RELATED APPLICATIONS

This application is a continuation of PCT international application Ser. No. PCT/JP2015/075047 filed on Sep. 3, 2015 which designates the United States, incorporated herein by reference, and which claims the benefit of priority from Japanese Patent Applications No. 2014-255416, filed on Dec. 17, 2014, incorporated herein by reference.

BACKGROUND

The present disclosure relates to an optical element processing tool and an optical element manufacturing method.

As an optical element processing tool to grind or polish an optical element such as a lens, a pellet-like grindstone obtained by solidifying abrasive grains and molding the same into a cylindrical shape is used. For example, proposed is an optical element processing tool in which a grindstone having an upper surface molded into a spherical shape conforming to a processing target spherical shape of the optical element is used and a counterbore to fix the grindstone is provided at a pasting surface for a spherical grindstone, thereby improving placement accuracy of a grindstone and stabilizing a spherical surface shape of an optical element to be processed (refer to JP 2000-084820 A, for example).

SUMMARY

An optical element processing tool according to one aspect of the present disclosure is an optical element processing tool for grinding or polishing an optical element including: a base plate including a fixing region having a predetermined curvature; and a plurality of grindstones each formed in a columnar body having a same initial height, one end surface of the columnar body having an initial shape molded into a first spherical shape conforming to a processing target spherical shape of the optical element, and the other end surface of the columnar body being fixed to the fixing region of the base plate, wherein a grindstone deviant from a condition among the plurality of grindstones, which is the grindstone not meeting a condition determined by a processing tool diameter of the processing tool, includes an outer end portion cut out at least in parallel to a center axis of the base plate so as to meet the condition.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Figure 1:
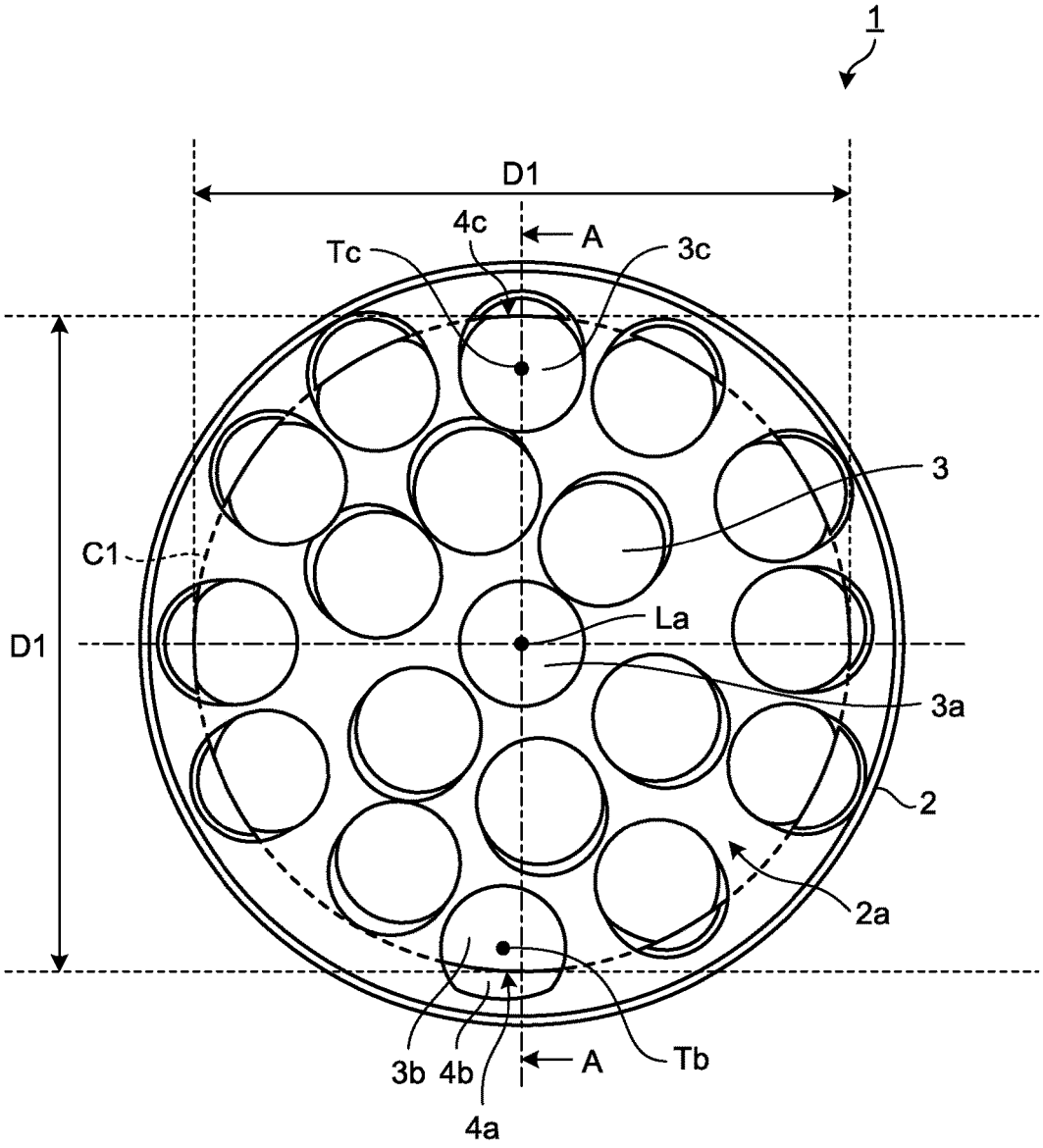
FIG. 1 is a plan view of an optical element processing tool according to a first embodiment.

In the following description, an optical element processing tool for grinding or polishing an optical element will be described as a mode to implement the present disclosure (hereinafter referred to as "embodiment"). Additionally, note that the present disclosure is not limited to this embodiment. Furthermore, in the drawings, a same portion is denoted by a same reference sign. Moreover, it should be noted that the drawings are schematic illustrations and a relationship between a thickness and a width of each member, a proportion of each member, and the like may differ from those used in practice. Also, note that portions having sizes or proportions different from each other between the drawings are included as well.

First Embodiment

Figure 2:
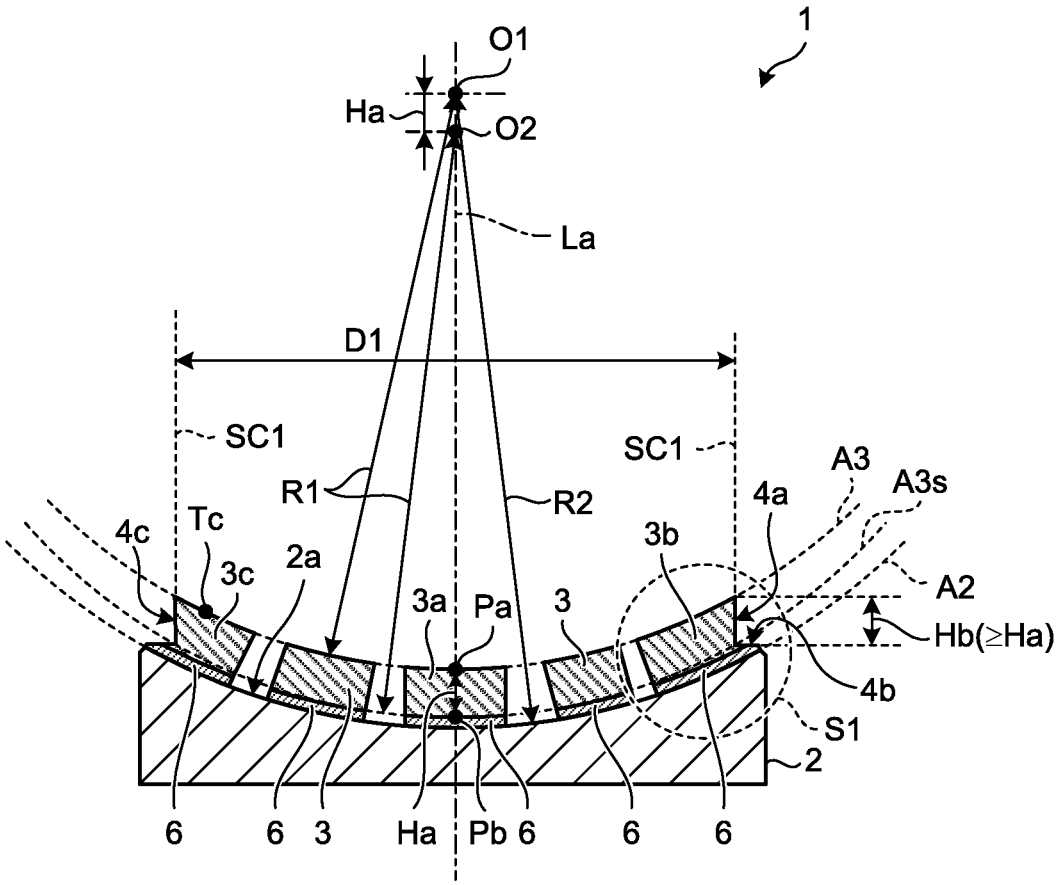
FIG. 2 is a cross-sectional view taken along a line A-A in FIG. 1.
Figure 3:
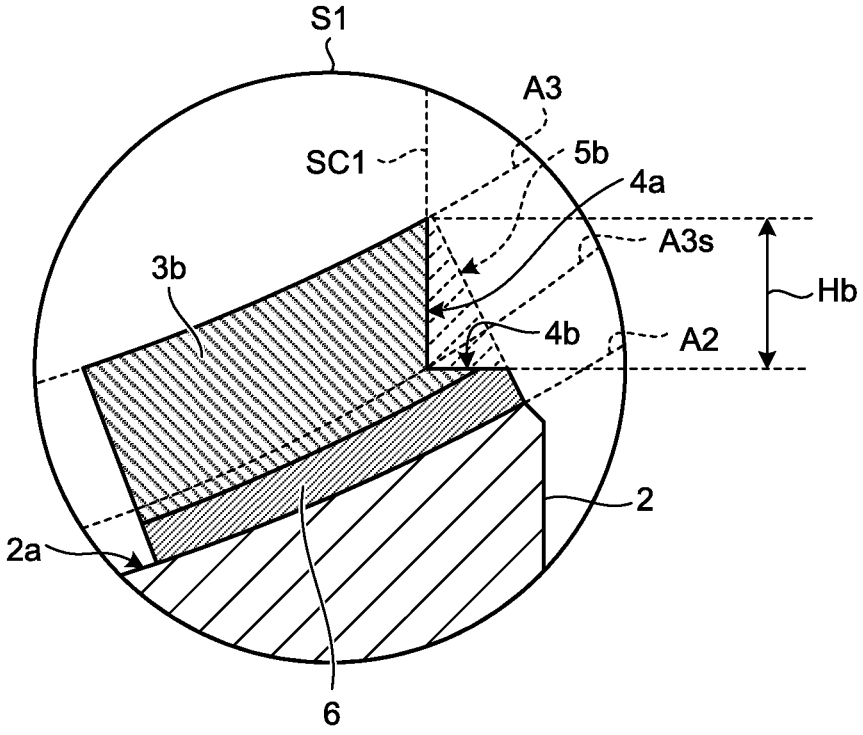
FIG. 3 is an enlarged view of a main portion of the processing tool illustrated in FIG. 2.

FIG. 1 is a plan view of an optical element processing tool according to a first embodiment of the present disclosure. FIG. 2 is a cross-sectional view taken along a line A-A in FIG. 1. FIG. 3 is an enlarged view of a main portion (region S1) of the processing tool illustrated in FIG. 2.

The optical element processing tool 1 illustrated in FIGS. 1 and 2 is a tool used to process a surface to be processed in an optical element material into a shape forming a part of a spherical surface (hereinafter referred to as "spherical shape"). The processing tool 1 is adapted to process the optical element material into a projecting spherical shape.

The processing tool 1 according to the present first embodiment includes: a base plate 2; and a plurality of grindstones 3 fixed to an upper surface 2*a* (fixing region) of the base plate 2 with an adhesive 6. A processing target spherical shape of the optical element material to be processed is a spherical shape having a spherical center at a center axis La of the base plate 2 and having a curvature radius R1. A processing tool diameter of the processing tool 1 is set to D1. In the example of FIG. 1, the plurality of grindstones 3 is arranged on the upper surface 2*a* of the base plate 2 at uneven intervals.

The upper surface 2*a* of the base plate 2 has a predetermined curvature and a shape molded into a spherical shape in which a spherical center O1 is located on the center axis La of the base plate 2. A curvature radius of the upper surface 2*a* is a value R2 obtained by adding an initial height Ha of the grindstone 3 and a thickness of the adhesive 6 described later to the curvature radius R1. In other words, as illustrated in FIG. 2, in the case of viewing a cross-section of the base plate 2, the upper surface 2*a* forms a shape formed along an arc A2 conforming to a spherical shape which has a spherical center at a point O1 on the center axis La and has the curvature radius R2. The base plate 2 is formed of, for example, a metal or an alloy of copper, brass, and stainless, and the like.

The grindstone 3 is obtained by solidifying abrasive grains including diamond and the like and molding the same into a pellet having a cylindrical shape and then molding both bottom surfaces of the pellet into a predetermined shape. The grindstone 3 may be metal-based or plastic-based such as a resin.

Each of the plurality of grindstones 3 has a columnar body having the same initial height Ha. Each of the grindstones 3 has an upper end surface, namely, one end surface in a height direction having a shape molded into a spherical shape (first spherical shape) conforming to the processing target spherical shape of the optical element. An initial shape of the upper end surface of each grindstones 3 is molded into the spherical shape having the spherical center O1 located on the center axis La of the base plate 2 and having the curvature radius R1, and in the case of viewing the cross-section thereof like FIG. 2, the upper end surface forms a shape formed along an arc A3 conforming to the spherical shape having the spherical center at the point O1 on the center axis La and having the curvature radius R1. A lower end surface that is the other end surface in the height direction of each grindstone 3 is respectively fixed to the upper surface 2*a* of the base plate 2 with the adhesive 6. The plurality of grindstones 3 all has the same shape.

In the processing tool 1, among the plurality of grindstones 3, grindstones deviant from a condition (such as grindstones 3*b*, 3*c*) which are the grindstones not meeting a condition determined by the processing tool diameter D1 have outer end portions cut out at least in parallel to the center axis La so as to meet the condition.

A projection region, on which a circle having the center axis La as a center and having a diameter of the processing tool diameter D1 is projected in parallel to the center axis La, is defined as a projection region C1 (refer to FIG. 1) for illustrative purposes. This projection region C1 has a cylindrical shape in which a diameter is the processing tool diameter D1 and a center axis is the axis La. In FIG. 2, a side surface of the projection region C1 having such a cylindrical shape is indicated by a dotted line SC1. The grindstone deviant from the condition is a grindstone partly included in a region deviated from this projection region C1.

In the grindstones 3*b*, 3*c* illustrated in FIG. 2, the outer end portions are cut out such that grind surfaces are prevented from being located in the region more outside than the projection region C1. Among them, as for the grindstone 3*b*, a portion 5*b* deviated from the projection region C1 is cut out in parallel to the center axis La along the side surface SC1 of the projection region C1 as illustrated in FIG. 3. As for the grindstone 3*c* also, a portion deviated from the projection region C1 is cut out in parallel to the center axis La along the side surface SC1 of the projection region C1 in a similar manner. Therefore, a cut-out surface 4*a* of the grindstone 3*b* and a cut-out surface 4*c* of the grindstone 3*c* have shapes formed along the side surface SC1.

The grindstone deviant from the condition has a spherical center at a position O2 obtained by moving the spherical center O1 along the center axis La in a direction to a lower end surface Pb from an upper end surface Pa of the grindstone 3*a* by the initial height Ha of the grindstone 3, and also is cut out up to above a position where the projection region C1 intersects with the second spherical shape having the curvature radius R1. An arc A3*s* conforms to the second spherical shape. The grindstones 3*b*, 3*c* have the outer end portions cut out up to above the position where the arc A3*s* intersects with the side surface SC1 of the projection region C1 A cut-out surface 4*b* of the grindstone 3*b* is a surface orthogonal to the side surface SC1, and the cut-out end portion corresponds to the position where the arc A3*s* intersects with the side surface SC1.

In the processing tool 1, a fixing position of each grindstone 3 is adjusted so as to have a center of the upper end surface of the grindstone located inside the projection region C1 such that a grind surface having a constant area may be secured even in the grindstone deviant from the condition and having the outer end portion cut out. For example, in the case of grindstones 3*b*, 3*c*, fixing positions of a center Tb of the upper end surface of the grindstone 3*b* (refer to FIG. 1) and a center Tc of the upper end surface of the grindstone 3*c* (refer to FIGS. 1 and 2) are set so as to be located inside the projection region C1.

Figure 4:
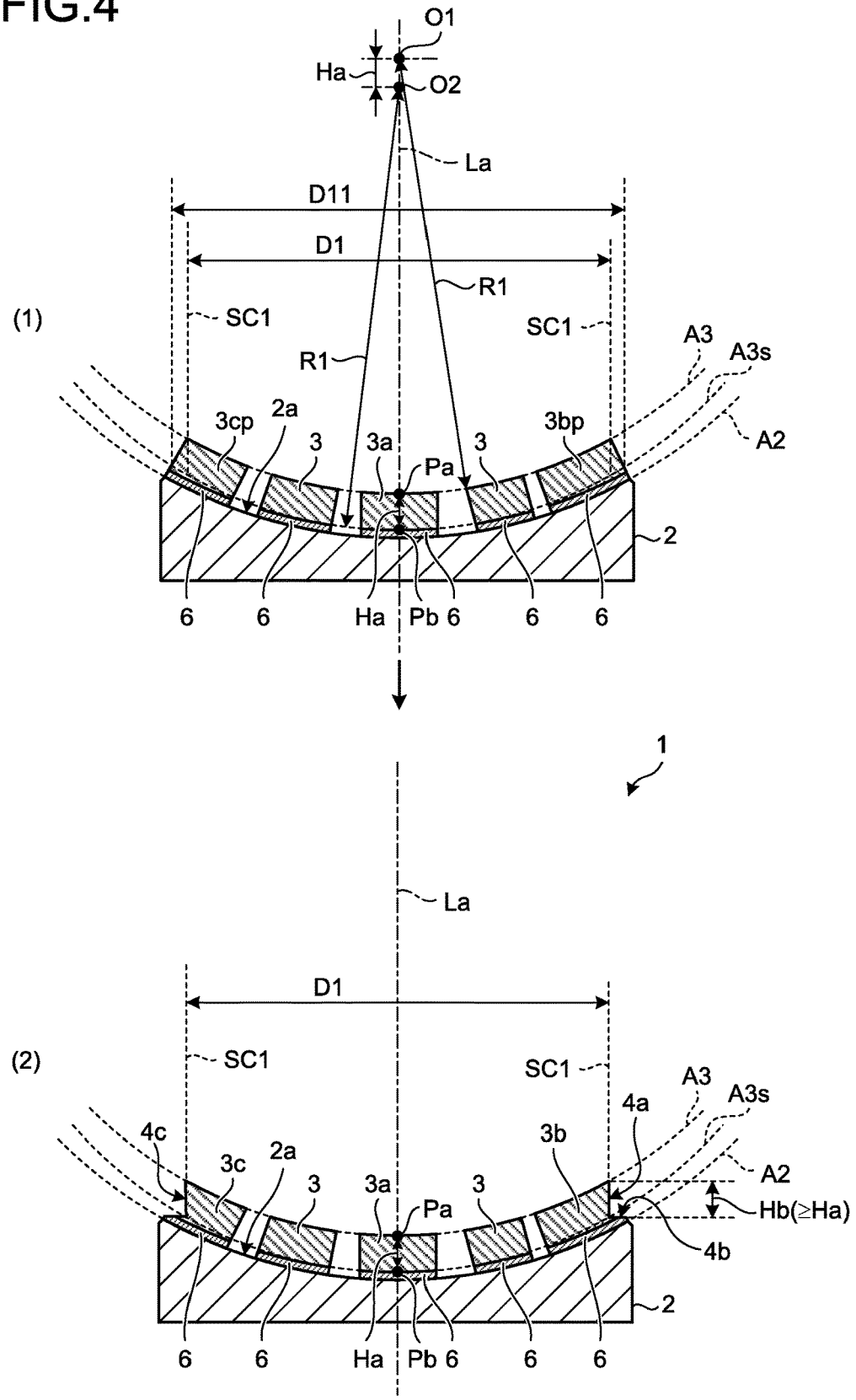
FIG. 4 is a view to describe a manufacturing method for the optical element processing tool illustrated in FIG. 1.

FIG. 4 is a view to describe a manufacturing method for the optical element processing tool 1 illustrated in FIG. 1. The processing tool 1 is completed by: fixing each of the grindstones 3 on the upper surface 2*a* of the base plate 2 with the adhesive 6 as illustrated in (1) of FIG. 4; and then cutting out portions deviated from the projection region C1 of grindstones deviant from the condition (e.g., grindstones 3*bp*, 3*cp*) in parallel to the center axis La along the side surface SC1 of the projection region C1 as illustrated in (2) of FIG. 4. Such a cut-out process is executed by using a grinding and cutting tool such as a curve generator (CG) machine and a file.

By the way, the grindstone 3 is abraded by repeatedly processing an optical element, and a height thereof is gradually reduced. An abrasion loss of the grindstone 3 is varied by an arrangement position on the upper surface 2*a* of the base plate 2, and it is known from experience that an inner-side grindstone 3 (e.g., center grindstone 3*a*) is abraded faster than outer-side grindstones 3 (e.g., grindstones 3*bp*, 3*cp* at outer ends) are. In the case where the center grindstone 3*a* which is abraded fastest is abraded down to the lower end surface Pb, an optical element material may not be processed into a target spherical shape. Additionally, it is known that each grindstone 3 has a shape of the upper end surface gradually abraded while keeping its spherical shape having the curvature radius R1 although the spherical center is gradually moved in a direction of the center axis La. In the case of viewing the cross-section of the upper end surface of each grindstone 3 as illustrated in FIG. 2, the initial shape formed along the arc A3 is changed to a shape formed along the arc A3*s* along with progress of abrasion.

As illustrated in (1) of FIG. 4, the outer-end grindstones 3*bp*, 3*cp* having side surface portions included in the region deviated from the side surface SC1 of the projection region C1 are fixed in a manner tilted from the center axis La while conforming to the curvature of the base plate 2. Therefore, when abrasion progresses in the center axis La direction, the outer end portions of the upper end surfaces of the grindstones 3*bp*, 3*cp* expand outward from the side surface SC1 of the projection region C1, and the processing tool diameter of the processing tool is gradually increased from the processing tool diameter D1. In the case where abrasion progresses down to the lower end surface Pb of the center grindstone 3*a*, the upper end surface of each grindstone 3 comes to have the spherical shape conforming to the arc A3*s*. In this case, since the upper end surfaces of the outer-end grindstones 3*bp*, 3*cp* also expand outward from the side surface SC1 along the arc A3*s*, the processing tool diameter of the processing tool becomes D11 (>D1) and is changed from the target diameter (D1).

In the present first embodiment, as for the grindstones at the outer end portions (e.g., grindstones 3*bp*, 3*cp*) partly included in the region deviated from the projection region C1, at least the outer end portions deviated from the projection region C1 are cut out in parallel to the center axis La as illustrated in (2) of FIG. 4, thereby abrading the outer end portions of the upper end surfaces of the grindstones 3*b*, 3*c* while keeping the shape formed along the side surface SC1 of the projection region C1 even when abrasion progresses.

Moreover, in the present first embodiment, the initial height and the like of the grindstone 3 may be set such that the grindstones deviant from the condition (e.g., grindstones 3*b*, 3*c*) may keep cut-out surfaces (e.g., cut-out surfaces 4*a*, 4*c*) in a shape formed along the side surface SC1 of the projection region C1 even in the case where the center grindstone 3*a* is all used up. A length Hb illustrated in FIGS. 2 and 3 is a length of a straight line that connects a position where the side surface SC1 of the projection region C1 intersects with the arc A3 to a position where the arc A3*s* intersects with the side surface SC1 in the grindstone deviant from the condition (e.g., grindstone 3*b*) in a manner parallel to the center axis La. In the present first embodiment, the initial height Ha of each grindstone 3, a size of the upper surface 2*a* of the base plate 2, and the like may be set such that the length Hb of the straight line that connects the intersection point between the first spherical shape and the projection region to the intersection point between the second spherical shape and the projection region becomes the initial height Ha or more of the grindstone 3 in a height direction of the center axis La in the grindstone deviant from the condition. With such setting, in the case of using the processing tool 1 until the center grindstone 3*a* is abraded down to the lower end surface Pb, in other words, even in the case of using the processing tool 1 until the center grindstone 3*a* is abraded by an amount corresponding to the initial height Ha, the cut-out surfaces 4*a*, 4*c* of the grindstones 3*b*, 3*c* located at the outer end portions may keep the shape formed along the side surface SC1 of the projection region C1, and the processing tool 1 may keep the processing tool diameter D1.

Thus, in the present first embodiment, even when abrasion of the grindstone 3 progresses, the processing tool diameter D1 of the processing tool 1 may be kept constant because the outer end portion of the grindstone deviant from the condition, which does not meet the condition determined by the processing tool diameter D1 of the processing tool 1, is cut out at least in parallel to the center axis La so as to meet the condition. Therefore, quality of the processed surface of the optical element may be stabilized, and quality of the optical element may be kept constant.

Furthermore, the processing tool 1 of the present first embodiment may be formed of only the grindstones 3 each having the same shape, and may be manufactured by a simple process of cutting out only an outer end portion of a grindstone deviant from a condition among the plurality of grindstones 3 so as to meet the condition. Meanwhile, the grindstone 3 has the upper end surface molded in a manner conforming to the first spherical shape, and multiple kinds thereof having various diameters may also be used as far as the grindstone has a columnar body with the initial height Ha. Additionally, in the present first embodiment, the case of fixing the grindstones 3 to the upper surface 2*a* of the base plate 2 in an irregular manner has been described, but needless to mention, the grindstones may be fixed in a regular manner.

Figure 5:
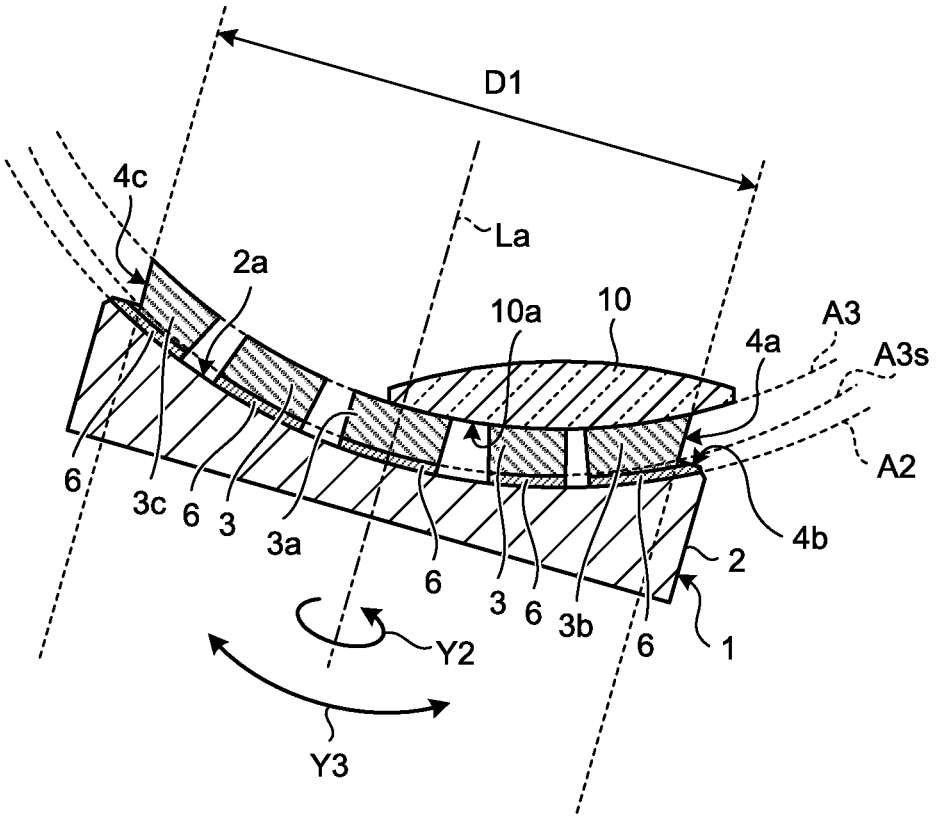
FIG. 5 is a partial cross-sectional view to describe an optical element manufacturing method by using the processing tool illustrated in FIG. 1.

Next, an optical element manufacturing method by using the processing tool 1 will be described with reference to FIG. 5. FIG. 5 is a partial cross-sectional view to describe the optical element manufacturing method by using the processing tool 1.

First, the processing tool 1 is installed at a polishing device or a grinding device not illustrated, and an optical element material 10 to be processed is installed at a jig (not illustrated) provided in the polishing device or the grinding device, and then a process to bring an upper surface of each grindstone 3, namely, a grind surface of the processing tool 1 into contact with a surface to be processed 10*a* of the optical element material 10. Subsequently, the polishing device or the grinding device rotates the processing tool 1 while setting the center axis La of the base plate 2 as a rotational axis, and also a processing step to grind or polish the optical element material 10 is performed by sliding the processing tool 1. In other words, the polishing device or the grinding device rotates the processing tool 1 as indicated by an arrow Y2 and slides the same as indicated by an arrow Y3. After that, the optical element subjected to the processing is removed from the jig, thereby achieving the optical element in which the surface to be processed 10*a* is formed into a shape conforming to the upper surface of the grindstone 3, namely, the spherical shape having the curvature radius R1. According to the processing tool 1, even when abrasion of the grindstone 3 progresses, the processing tool diameter of the processing tool 1 may be kept at D1. Therefore, quality of a processed surface of an optical element may be stabilized. Meanwhile, in FIG. 5, exemplified is the case where the processing tool 1 is installed below an optical element and the processing tool diameter D1 is set larger than a diameter of the optical element, however; in the case of installing the processing tool 1 above the optical element, the processing tool diameter D1 is set smaller than the diameter of the optical element. Furthermore, in the example of FIG. 5, the processing tool 1 is tilted, but there may be a case where an optical element installed at an upper axis or a processing tool installed at the upper axis is set in a tilted manner.

Second Embodiment

Figure 6:
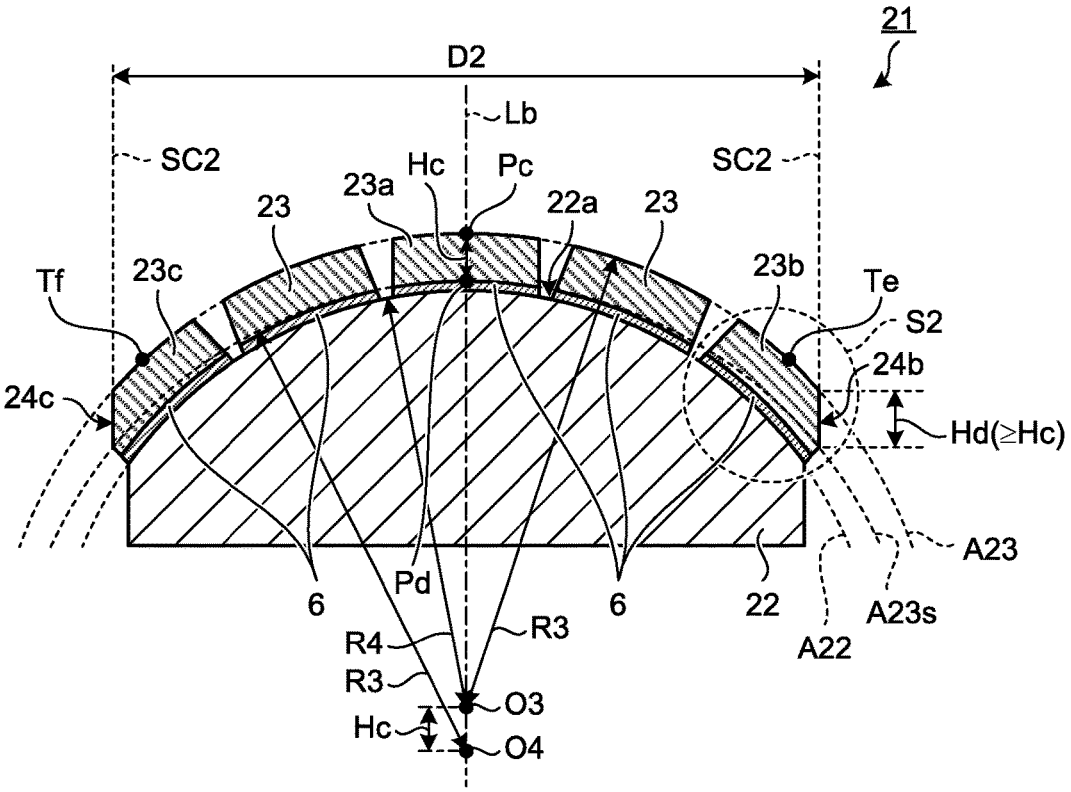
FIG. 6 is a view illustrating a cross section of an optical element processing tool according to a second embodiment taken along a plane passing a center axis of a base plate of the processing tool.
Figure 7:
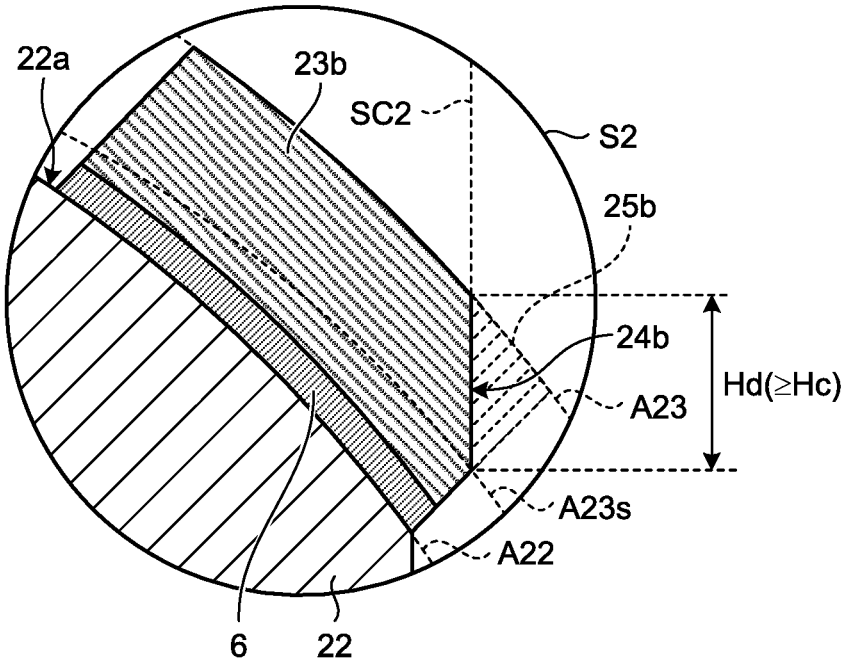
FIG. 7 is an enlarged view of a main portion of the processing tool illustrated in FIG. 6.

Next, a second embodiment will be described. FIG. 6 is a view illustrating a cross section of an optical element processing tool according to a second embodiment taken along a plane passing a center axis of a base plate of the processing tool. FIG. 7 is an enlarged view of a main portion (region S2) of the processing tool illustrated in FIG. 6. A processing tool 21 according to the second embodiment illustrated in FIG. 6 is adapted to process an optical element material into a recessed spherical shape.

As illustrated in FIG. 6, the processing tool 21 includes a base plate 22 and a plurality of grindstones 23 fixed to an upper surface 22*a* (fixing region) of the base plate 22 with an adhesive 6. A processing target spherical shape of the optical element material to be processed has a spherical center on a center axis Lb of the base plate 22 and has a curvature radius R3. A processing tool diameter of the processing tool 21 is set to D2. In FIG. 6, a side surface of a projection region, on which a circle having a center at the center axis Lb and having a diameter of the processing tool diameter D2 is projected in parallel to the center axis Lb, is indicated by a dotted line SC2. In the example of FIG. 6, the plurality of grindstones 23 is uniformly arranged on the upper surface 22*a* of the base plate 22.

The upper surface 22*a* of the base plate 22 has a predetermined curvature and has a shape molded into a spherical shape having a spherical center O3 located on the center axis Lb of the base plate 22. A curvature radius of the upper surface 22*a* is a value R4 obtained by subtracting an initial height Hc of the grindstone 23 and a thickness of the adhesive 6 described later from the curvature radius R3. In the case of viewing a cross-section of the base plate 22, the upper surface 22*a* forms a shape formed along an arc A22 conforming to the spherical shape which has the spherical center at a point O3 on the center axis Lb and has the curvature radius R4. The base plate 22 is formed of a material same as a base plate 2.

The grindstone 23 is formed of a material same as a grindstone 3. Each of the plurality of grindstones 23 has a columnar body having the same initial height Hc. An initial shape of an upper end surface of each grindstone 23 is molded into a spherical shape having the spherical center O3 located on the center axis Lb of the base plate 22 and having the curvature radius R3, and the upper end surface forms a shape formed along an arc A23 conforming to the spherical shape which has the spherical center at the point O3 on the center axis Lb and has the curvature radius R3. A lower end surface of each grindstone 23 is respectively fixed to the upper surface 22*a* of the base plate 22 with the adhesive 6.

In the case where an upper end surface Pc of a center grindstone 23*a* abraded fastest is abraded down to a lower end surface Pd, the upper end surface of each grindstone 23 is changed from the shape formed along an arc A23 to a shape formed along an arc A23*s*. The arc A23*s* has a spherical center at the spherical center O4 obtained by moving the spherical center O3 along the center axis Lb in a direction from the upper end surface Pc to the lower end surface Pd of the grindstone 23*a* by the initial height Hc of the grindstone 23, and also conforms to the spherical shape that has the curvature radius R3. In the second embodiment, as for a grindstone 23*b* partly located in a region more outside than the side surface SC2 of the projection region, a portion 25*b* deviated from the side surface SC2 of the projection region is cut out at least up to above a position where the arc A23*s* intersects with the side surface SC2 as illustrated in FIG. 7 in a manner similar to the first embodiment. A cut-out surface 24*b* of the cut-out portion has a shape formed along the side surface SC2. Additionally, as for a grindstone 23*c* also, a portion deviated from the side surface SC2 of the projection region is cut out at least up to a position where the arc A23*s* intersects with the side surface SC2 as illustrated in FIG. 6, and the cut-out surface 24*c* along the side surface SC2 is formed.

Additionally, in the processing tool 21 also, a height or the like of the cut-out surface may be set such that the cut-out surfaces (e.g., cut-out surfaces 24*b*, 24*c*) may be kept in the shape formed along the side surface SC2 of the projection region even in the case of using up the entire center grindstone 23*a*. A length Hd illustrated in FIGS. 6 and 7 is a length of a straight line that connects a position where the side surface SC2 of the projection region intersects with the arc A23 to a position where the arc A23*s* intersects with the side surface SC2 in a manner parallel to the center axis Lb. In the present second embodiment also, the length Hd may be set so as to be the initial height Hc or more of the grindstone 23 in a manner similar to the first embodiment, and in this case, even when the processing tool 21 is used until the center grindstone 23*a* is abraded down to the lower end surface Pd, the cut-out surfaces 24*b*, 24*c* of the grindstones 23*b*, 23*c* corresponding to the grindstones deviant from a condition may keep the shape formed along the side surface SC2 of the projection region, and the processing tool diameter D2 may be kept.

Furthermore, in the second embodiment also, as for the grindstone deviant from the condition, a fixing position of each grindstone 23 is adjusted so as to locate the center of the grindstone deviant from the condition inside the projection region such that a grind surface may secure a constant area. Specifically, like the grindstones 23*b*, 23*c*, fixing positions of the grindstones 23*b*, 23*c* are set such that a center Te of the upper end surface of the grindstone 23*b* (refer to FIG. 6) and a center Tf of the upper end surface of the grindstone 23*c* (refer to FIG. 6) are located more inside than the side surface SC2 of the projection region.

Figure 8:
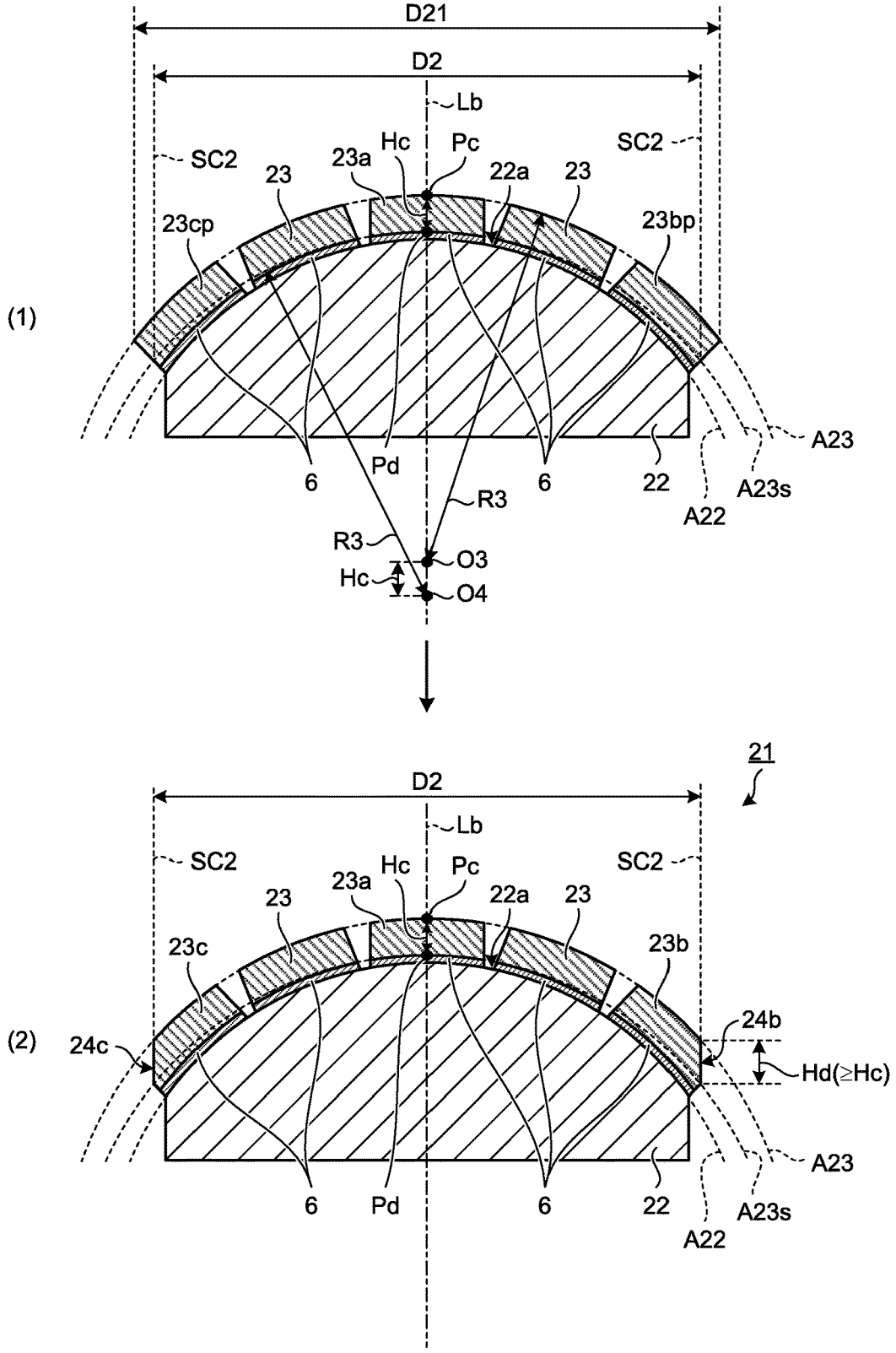
FIG. 8 is a view to describe a manufacturing method for the optical element processing tool according to the second embodiment.

FIG. 8 is a view to describe a manufacturing method for the optical element processing tool 21 illustrated in FIG. 6. The processing tool 21 is completed by: fixing the respective grindstones 23 on the upper surface 22*a* of the base plate 22 with the adhesive 6 as illustrated in (1) of FIG. 8; and then cutting out, in parallel to the center axis Lb along the side surface SC2 of the projection region, portions of grindstones deviant from the condition (e.g., grindstones 23*bp*, 23*cp*) deviated from the side surface SC2 of the projection region as illustrated in (2) of FIG. 8. Such a cut-out process is executed by using a grinding and cutting tool such as a CG machine and a file in a similar manner as the first embodiment.

As it has been described in the first embodiment, in the case where there is no cut-out portion in the outer-side grindstones 23*bp*, 23*cp*, when the center grindstone 23*a* is abraded down to the lower end surface Pd, the upper end surface of each grindstone 23 comes to have the spherical shape conforming to the arc A23*s*, and outer ends of the upper end surfaces of the outer-end grindstones 23*bp*, 23*cp* reach closer to the side surface SC2 side from the outside of the side surface SC2 of the projection region, in other words, a diameter of the projection region becomes smaller. Therefore, the processing tool diameter of the processing tool is reduced to D2 (<D21). In the present second embodiment also, as for the grindstones deviant from a condition, located at the outer end portions, and partly included in the region deviated from the projection region (e.g., grindstones 23*b*, 23*c*), at least the portion deviated from the projection region is cut out in parallel to the center axis Lb. Additionally, as for the processing tool 21 also, even when abrasion of the grindstone 23 progresses, the processing tool diameter D2 of the processing tool 21 may be kept constant while the outer end portions of the upper end surfaces of the outer-side grindstones 23*b*, 23*c* are abraded along the side surface SC2 of the projection region. Therefore, effects similar to the first embodiment may also be provided in the processing tool 21 according to the present second embodiment.

Figure 9:
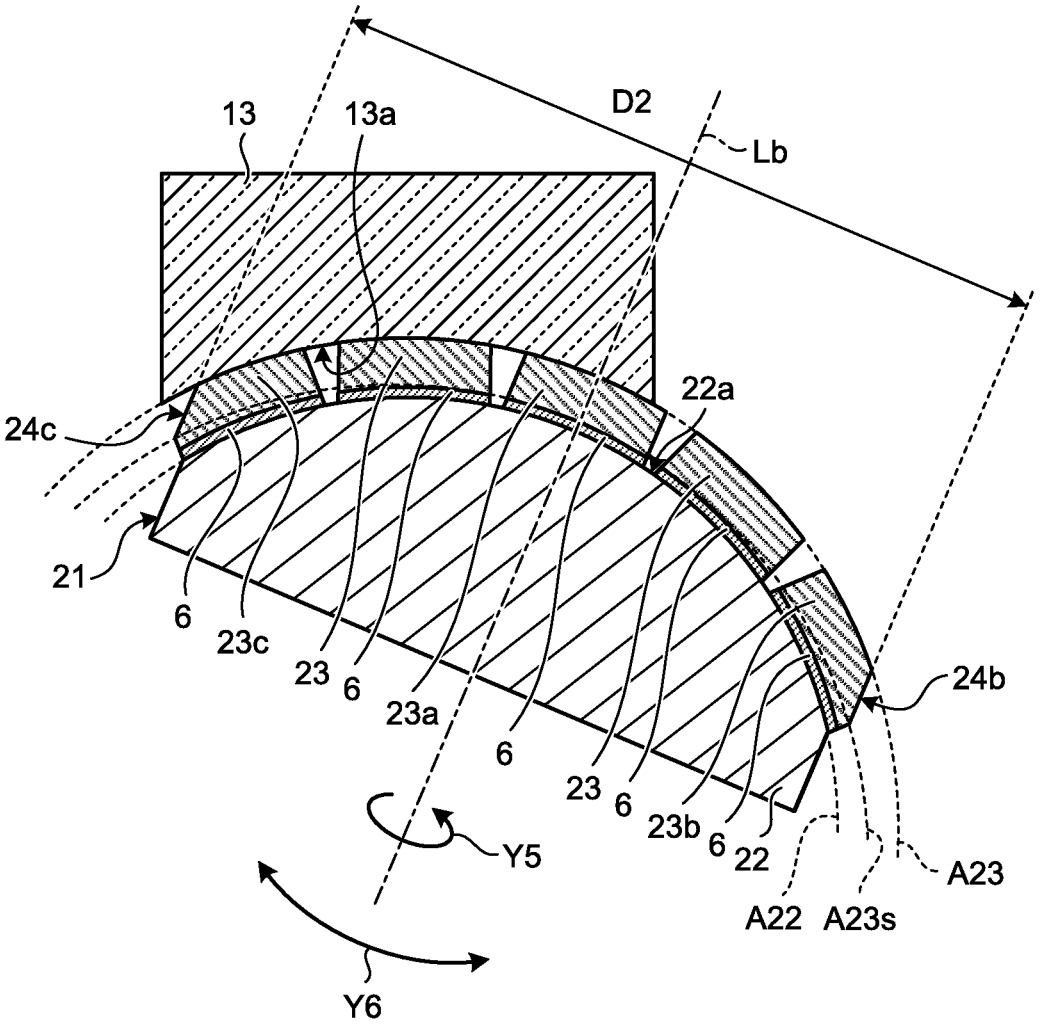
FIG. 9 is a partial cross-sectional view to describe an optical element manufacturing method by using the processing tool illustrated in FIG. 6.

Meanwhile, FIG. 9 is a partial cross-sectional view to describe an optical element manufacturing method by using the processing tool 21. First, the processing tool 21 is installed at a polishing device or a grinding device not illustrated, and an optical element material 13 to be processed is set at a jig (not illustrated) provided in the polishing device or the grinding device, and then a process to bring an upper surface of each grindstone 23, namely, a grind surface of the processing tool 21 into contact with a surface to be processed 13*a* of the optical element material 13. Subsequently, the polishing device or the grinding device rotates the processing tool 21 as indicated by an arrow Y5 while setting the center axis Lb of the base plate 22 as a rotational axis, and also a processing step to grind or polish the optical element material 13 is performed by sliding the processing tool 21 as indicated by an arrow Y6. After that, the optical element subjected to the processing is removed from the jig, thereby achieving the optical element in which the surface to be processed 13*a* is formed into the spherical shape having the curvature radius R3. According to the processing tool 21, even when abrasion of the grindstone 23 progresses, the processing tool diameter of the processing tool 21 may be kept at D2. Therefore, quality of the processed surface of the optical element may be stabilized. Meanwhile, in the case of installing the processing tool 21 on an optical element similar to the first embodiment, the processing tool diameter D2 is set smaller than a diameter of the optical element, and the optical element installed at an upper axis or the processing tool installed at the upper axis is set in a tilted manner.

According to the present disclosure, an optical element processing tool includes: a base plate including a fixing region having a predetermined curvature; and a plurality of grindstones each formed in a columnar body having a same initial height, one end surface of the columnar body having an initial shape molded into a first spherical shape conforming to a processing target spherical shape of the optical element and the other end surface of the columnar body being fixed to the fixing region of the base plate. Among the plurality of grindstones, a grindstone deviant from a condition, which is the grindstone not meeting a condition determined by a processing tool diameter of the processing tool, has an outer end portion cut out at least in parallel to a center axis of the base plate so as to meet the condition. Therefore, by keeping the processing tool diameter constant even though the grindstone is abraded, quality of a processed surface of the optical element subjected to the processing may be stabilized, and quality of the optical element may be kept constant.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An optical element processing tool for grinding or polishing an optical element, the optical element processing tool comprising:

a base plate including a fixing region having a predetermined curvature; and a plurality of grindstones each comprising a columnar body and each having a same initial height, a first end surface of the columnar body having an initial shape corresponding to a first spherical shape conforming to a processing target spherical shape of the optical element, and a second end surface of the columnar body being fixed to the fixing region of the base plate, wherein the plurality of grindstones include a grindstone deviant from a condition, which is a grindstone disposed to partly deviate from a region that satisfies a condition determined by a processing tool diameter of the processing tool, and wherein a part deviating from the region is cut out from the grindstone deviant from the condition in parallel to a center axis of the base plate.

2. The optical element processing tool according to claim 1, wherein:

the first spherical shape has a first spherical center located on the center axis of the base plate and has a first curvature radius, the fixing region of the base plate has a shape corresponding to a spherical shape having a spherical center located on the center axis of the base plate, the grindstone deviant from the condition is a grindstone partly included in a region deviated from a projection region on which a circle having the center axis as a center and having a diameter corresponding to the processing tool diameter is projected in parallel to the center axis, and a portion deviated from the projection region is cut out from the grindstone deviant from the condition.

3. The optical element processing tool according to claim 2, wherein:

the grindstone deviant from the condition has an outer end portion cut out up to above a position where a second spherical shape intersects with the projection region, and the second spherical shape has the first curvature radius and a second spherical center obtained by moving the first spherical center by an initial height of each of the plurality of grindstones in a direction from the first end surface to the second end surface of each of the plurality of grindstones along the center axis.

4. The optical element processing tool according to claim 2, wherein the grindstone deviant from the condition is fixed to the fixing region such that a center of the first end surface of the grindstone deviant from the condition is located inside the projection region.

5. An optical element manufacturing method using the optical element processing tool of claim 1, the optical element manufacturing method comprising:

bringing the first end surface of each of the grindstones of the optical element processing tool into contact with an optical element material to be processed; and performing processing to grind or polish the optical element material by rotating the optical element processing tool with the center axis of the base plate as a rotational axis.

6. An optical element processing tool for grinding or polishing an optical element, the optical element processing tool comprising:

a base plate including a fixing region having a predetermined curvature; and a plurality of grindstones each having a same initial height, a first end surface of each of the grindstones having an initial shape corresponding to a first spherical shape conforming to a processing target spherical shape of the optical element, and a second end surface of each of the grindstones being fixed to the fixing region of the base plate, wherein:

the first spherical shape has a first spherical center located on a center axis of the base plate;

the plurality of grindstones include a first grindstone, the first surface of the first grindstone being located entirely within a projection region on which a circle having the center axis as a center and having a diameter corresponding to a processing tool diameter is projected in parallel to the center axis;

the plurality of grindstones further include a second grindstone that has a cutaway portion including a cut surface at a boundary of the projection region, such that the first surface of the second grindstone does not extend outside of the projection region;

the cut surface of the second grindstone is parallel to the center axis of the base plate; and the first grindstone does not have the cutaway portion.

* * * * *